US006982011B1

(12) United States Patent
Pfeifenbring et al.

(10) Patent No.: US 6,982,011 B1
(45) Date of Patent: Jan. 3, 2006

(54) METHOD FOR PRODUCING IMPROVED COLD-ROLLED STRIP THAT IS CAPABLE OF BEING DEEP-DRAWN OR IRONED, AND COLD-ROLLED STRIP, PREFERABLY USED FOR PRODUCING CYLINDRICAL CONTAINERS AND, IN PARTICULAR, BATTERY CONTAINERS

(75) Inventors: Karlfried Pfeifenbring, Düisberg (DE); Hans-Güenter Steinmann, Düesseldorf (DE); Ferdinand Schmidt, Düsseldorf (DE); Werner Olberding, Velbert (DE); Marcel Sebastian Rubart, Dislaken (DE)

(73) Assignee: Hille & Mueller GmbH, Duesseldorf (DE)

( * ) Notice: Subject to any disclaimer, the term of this patent is extended or adjusted under 35 U.S.C. 154(b) by 471 days.

(21) Appl. No.: 10/049,152

(22) PCT Filed: Aug. 3, 2000

(86) PCT No.: PCT/EP00/07503

§ 371 (c)(1),
(2), (4) Date: May 3, 2002

(87) PCT Pub. No.: WO01/11114

PCT Pub. Date: Feb. 15, 2001

(30) Foreign Application Priority Data

Aug. 6, 1999 (DE) ..... 199 37 271

(51) Int. Cl.
*C21D 8/02* (2006.01)

(52) U.S. Cl. ..... 148/518; 148/530; 148/534

(58) Field of Classification Search ..... 148/518, 148/543

See application file for complete search history.

(56) References Cited

U.S. PATENT DOCUMENTS

| | | | | |
|---|---|---|---|---|
| 4,910,096 | A | 3/1990 | Junkers | |
| 5,425,798 | A * | 6/1995 | Sasaki et al. | 75/347 |
| 5,690,755 | A * | 11/1997 | Yoshinaga et al. | 148/533 |
| 6,129,992 | A * | 10/2000 | Sakuma et al. | 428/611 |
| 2001/0001049 | A1 * | 5/2001 | Higo et al. | 428/659 |

FOREIGN PATENT DOCUMENTS

| | | | |
|---|---|---|---|
| DE | 37 26 518 | C2 | 6/1989 |
| DE | 196 10675 | C1 | 2/1997 |
| DE | 197 10 125 | A1 | 9/1998 |
| EP | 0 402 514 | A1 | 12/1990 |
| EP | 0 629 009 | B1 | 8/1997 |
| EP | 0 809 307 | A2 | 11/1997 |
| JP | 1978-834158 | | 10/1978 |
| JP | 1991-154014 | | 4/1991 |

* cited by examiner

*Primary Examiner*—George Wyszomierski
(74) *Attorney, Agent, or Firm*—Hahn Loeser & Parks, LLP; John J. Cunniff

(57) ABSTRACT

The invention relates to a method for producing improved cold-rolled band that is capable of being deep-drawn or ironed and that has a carbon content of less than 0.5 weight %. The invention also relates to a cold-rolled band that can be produced by such a method, and preferably used for producing cylindrical containers and, in particular, battery containers by deep-drawing or ironing. The band that is cold-rolled with a cold-rolling ratio ranging from 30 to 95% is subjected to a thermal treatment in an annealing furnace and to a—preferably galvanic—coating of at least one of the two band surfaces. In order to obtain an isotropic steel band that has a low level of texturing and that has a low tendency to form earing, the coating produced with one or multiple layers contains the elements of nickel/cobalt/iron/bismuth/indium/palladium/gold/tin, or alloys thereof, where the thermal treatment is effected by annealing, which is carried out—before or after the coating process—in a continuously running band-annealing furnace at a temperature greater than the limit temperature of the austenite range (γ range).

43 Claims, No Drawings

METHOD FOR PRODUCING IMPROVED COLD-ROLLED STRIP THAT IS CAPABLE OF BEING DEEP-DRAWN OR IRONED, AND COLD-ROLLED STRIP, PREFERABLY USED FOR PRODUCING CYLINDRICAL CONTAINERS AND, IN PARTICULAR, BATTERY CONTAINERS

The invention relates to a method for producing improved cold-rolled band that is capable of being deep-drawn or ironed and that has a carbon content of less than 0.5 weight %, during which method the band cold-rolled with a cold-rolling ratio ranging from 30 to 95% is subjected to a thermal treatment in an annealing furnace and to a—preferably galvanic—coating of at least one of the two band surfaces. Furthermore, the invention relates to a cold band, used preferably for producing cylindrical containers and especially battery containers by deep-drawing or ironing, consisting of a band cold-rolled with a cold-rolling ratio ranging from 30 to 95%, with a carbon content of less than 0.5 weight %, and a coating produced in a galvanic process on at least one of the two band surfaces. Finally, the invention relates to a battery shell manufactured from such a cold band.

BACKGROUND OF THE ART

Document EP 0 809 307 A2 discloses a cold band with coating layers of nickel or nickel alloys deposited in a galvanic process. A part of the procedure is, furthermore, an annealing process performed in a multiple sequence, during which the steel band with a nickel coating is first annealed at the temperature of 640° C., i.e., the recrystallization temperature of the steel, with a subsequent annealing process at the same temperature, before another thermal treatment at a furnace temperature of 450° C. finally occurs. A consequence of the sequentially performed annealing processes is a change in the arrangement and nature of the structural crystals. The procedure according to EP 0 809 307 A2 endeavors to accomplish, by selecting corresponding galvanization processes, when the band is deep-drawn or ironed into battery shells that the harder of the two band surfaces later forms the inner side of the battery shell, whereas the other side—also coated with a nickel alloy but of lesser hardness—later forms the outer side of the battery.

Document DE 37 26 518 C2 describes a procedure for producing nickel-plated and cobalt-plated cold band that is subjected to thermal treatment at a temperature in the range of 580° to 710° C. The cold band with a carbon content of up to 0.07 weight % used in this procedure is pickled, cold-rolled, subsequently nickel-plated in a galvanic process, and then annealed at a temperature in the range of 580° to 710° C. to achieve recrystallization. Then follows rerolling or killing of the improved band. The method further proposes to deposit an additional layer of cobalt on the electrolytically applied nickel coating, which has a positive impact on the resistance of the finished band to corrosion. Furthermore, the document points out an enhanced diffusion speed due to the crystallization annealing, where the penetration of the coating metals into the base material of the steel band by way of diffusion demonstrates a depth several times greater than the depth of the nickel-cobalt coating.

Document EP 0 629 009 B1 describes a method for producing of a nickel-plated cold band with very low earing and an especially low carbon content of less than 0.009 weight %. Various alternatives are provided for the performance of the method and the sequence of the individual procedure steps. So, for example, it describes how after the nickel-plating process the annealed steel band is annealed a second time, which, however, results in a costly overall process. Furthermore, the document also describes how the cold band is first annealed and only then subjected to a galvanic process of nickel-plating, without any following diffusion annealing. The temperature range of 600° to 900° C. is indicated for the continual annealing process, and 2 minutes are indicated for the duration of annealing.

The task of this invention is to propose a method for producing improved cold-rolled band that is capable of being deep-drawn or ironed with a carbon content of less than 0.5 weight % resulting in an isotropic steel band that has a low level of texturing and that has a low tendency to form earing.

DETAILED DESCRIPTION OF THE PREFERRED EMBODIMENT

To resolve this task, the invention proposes a method of the nature described at the beginning, according to which a single or multiple coating contains the elements of nickel/cobalt/iron/bismuth/indium/palladium/gold/tin or their alloys and the thermal treatment occurs in the form of annealing of the band in a continually annealing furnace, before or after the coating, at a temperature above the limit temperature of the two-phase range ferrite/austenite ($\alpha/\gamma$ range in the iron-carbon system) to austenite range ($\gamma$ range in the iron-carbon system).

As a result of the normalization annealing with double crossing of the limit to the $\gamma$ range, the steel is brought into a fine-grained, homogeneous structure condition. Any structural and property changes caused by the preceding warm and cold forming processes and any thermal treatment are reversed by the normalization annealing above the limit temperature to the austenite range ($\gamma$ range). What happens is a comprehensive recrystallization of the structure resulting in a relatively small grain, which leads to a very low tendency to form earings, expressed by planar anisotropy $\Delta r$, during the subsequent use of the steel band for deep-drawing or ironing, e.g., of battery shells. The achieved small grain of globular shape is suitable even for extreme drawing ratios, where the fine structure causes a smooth surface of the drawn part. In addition, the fine-grain structure achieved by the normalization annealing in a continual annealing furnace enhances the corrosion resistance of the part drawn from improved cold band. The reason is a significantly diminished scale of forming small cracks in the galvanic coating during the drawing or ironing due to the very small grain size of the substrate.

The homogenizing of the mechanical properties and a complete change in the structural texture throughout the entire length and width of the band connected with the double structure transformation can also result in an increase in strength as compared to recrystallized material. This is advantageous especially for multiple-step drawing and ironing operations, which are performed at a high speed, e.g., in fast running presses. It diminishes the danger of necking and cracking defined by the tensile strength of the material.

Furthermore, as a result of the increased strength of the galvanized cold band, the normalization annealing in a continual annealing furnace leads to improved dimensional stability and very low earing formation in the drawn part, which is important especially in the manufacturing of battery shells or similar rotationally symmetrical products. The temperature required for the normalization annealing in a continual annealing furnace according to this invention depends on the carbon content in the used band material. For a decarbonized steel with a carbon content of no more than 0.01 weight %, the annealing temperature should lie in the range of 950° to 1000° C. with treatment duration of no more than 10 minutes. For higher carbon contents, e.g., 0.3 weight %, the annealing temperature is lower by about 100° C.; however, it still lies within the austenite range of the iron-carbon system.

The coating according to this invention is preferably deposited in a galvanic process, however, vacuum metallizing is also possible. Both procedures allow single-layer coating as well as multiple-layer coating. The coating of the two sides of the band can also be different from each other in order to achieve different mechanical, tribological and/or electrical properties on the two sides to improve the deep-drawing process.

If the coating, as proposed by this invention, containing the elements of nickel/cobalt/iron/bismuth/indium/palladium/gold/tin or their alloys is deposited before the annealing process, the coating adheres to the band material especially well due to diffusion [of the elements] deep into the material of the steel band caused by the thermal treatment. During the subsequent deep-drawing and ironing, a separation of the deposited coating layers from the base material becomes impossible. The normalization annealing at a temperature in the austenite range causes that the coating deposited on the band material and having an amorphous deposition structure is transformed into a globular structure with an improved ductility.

In order to achieve diffusion of the coating into the base material of the steel band of a sufficient penetration depth, the coating must occur before the annealing process. Another design version of the method proposes that the first coating is applied before the annealing process, and a second coating containing the elements of nickel/cobalt/iron/bismuth/indium/palladium/gold/tin or their alloys is deposited on the band after the annealing process.

To further improve the band's behavior during the deep drawing, after the normalization annealing the band should first be subjected to a temper pass roll procedure.

The additional coating process following the annealing process and the rerolling procedure should be performed using a galvanic bath with added organic ingredients in order to increase the hardness and brittleness of the resulting coating. This causes—at a later stage, during the drawing or ironing of the shell manufactured from the cold band according to this invention—the very brittle coating to crack open. If subjected to strong forming forces during the deep drawing or ironing, the side bearing a coating demonstrates an especially low electrical contact resistance, which is especially advantageous in the manufacturing of batteries with alkaline electrolytes. In comparison with the current state of art, the inner side of a battery shell manufactured in such a manner demonstrates very low values of the electrical contact resistance between the cathode substance of the battery and the inner surface of the battery shell.

The addition of the aforementioned organic ingredients to the electrolyte bath is especially advantageous if the subsequent coating is made of cobalt or a cobalt alloy.

Furthermore, it is advantageous to additionally introduce electrically conductive particles into the layer containing organic ingredients in order to improve its conductivity.

Electrically conductive particles of such substances as carbon, carbon black, graphite, $TaS_2$, $TiS_2$ and/or $MoSi_2$ can also be introduced into the first coating deposited before the annealing process. When the cold band is later used to manufacture battery shells, the contact resistance of the shell can be diminished using such imbedded particles. In addition, it is possible to deposit—in a galvanic process—a dispersion layer containing conductive particles such as carbon, carbon black, graphite, $TaS_2$, $TiS_2$ and/or $MoSi_2$ on top of the previous coating. The carbon content in the galvanic layer should be between 0.7 and 15 weight %. The most convenient material for the carbon suspended in the galvanic bath are finely distributed particles of carbon (graphite or carbon black). The particle size is preferably between 0.5 to 15 $\mu$m.

During the galvanization process a steady flow should be maintained in the galvanic bath in order to achieve a uniform distribution of the carbon in the galvanic layer. In order to achieve the steady flow, the galvanic bath is preferably revolved at a steady pace. A forced electrolyte flow speed of 6 to 10 m/s proved to be especially suitable. Furthermore, the galvanic bath can contain suspension-stabilizing and/or anti-clotting substances, in order to achieve a uniform distribution of the particles of carbon without any local or temporary concentrations.

In order to resolve the aforementioned task, this invention proposes with regard to the cold band with the initially indicated characteristics, that the coating contain the elements of nickel/cobalt/iron/bismuth/indium/palladium/gold/tin or their alloys, and that the band be thermally treated in a continual annealing furnace at an annealing temperature above the limit temperature of the two-phase range ferrite/austenite ($\alpha/\gamma$ range) to austenite range ($\gamma$ range).

Finally, the invention proposes that, besides the first coating, the cold band comprise an additional layer of the elements of nickel/cobalt/iron/bismuth/indium/palladium/gold/tin or their alloys. The following metals and their combinations are most convenient for the layer to be deposited in a galvanic or vacuum metallizing process: Cobalt, nickel/iron, nickel/cobalt, nickel/cobalt/iron, cobalt/iron, nickel/indium, iron/indium, nickel/bismuth, palladium, palladium/nickel, palladium/iron, palladium/cobalt, palladium/indium, and palladium/bismuth.

The temperature in a continual annealing furnace required for the normalization annealing of the cold band according to this invention depends on the carbon content in the band material used. For the so-called decarbonized steel with a carbon content of no more than 0.01 weight %, the annealing temperature should lie in the range of 950° to 1000° C. with treatment duration of no more than 10 minutes. For higher carbon contents, e.g., 0.3 weight %, the annealing temperature is lower by about 100° C.; however, it still lies within the austenite range of the iron-carbon system.

Subsequent to the normalization annealing process, an additional coating, preferably of cobalt or a cobalt alloy, can be deposited in a galvanic process. Organic ingredients are added to the electrolyte bath. Due to the flow of electrolyte during the galvanic coating process, the organic ingredients disintegrate into decomposition products. These products can then react with other substances contained in the electrolyte bath, e.g., with metal ions. Such reaction products are deposited, together with other decomposition products and cobalt or a cobalt alloy, on the cold band, and cause that the layer becomes significantly more brittle. In case of organic substances containing sulfur or carbon, these reaction products can be, e.g., cobalt sulfides or cobalt carbides.

The primary and secondary brighteners known from the galvanic nickel-plating process are suitable as organic ingredients of the electrolyte. Galvanic deposits involving by such ingredients result in a very hard and, at the same time, brittle coating, which is why the material has a strong tendency to crack during the forming process by way of deep drawing or ironing at a later stage. These cracks distinguish themselves by a relatively uniform structure with lozenge-shaped crack slabs.

Suitable brighteners proved to be substances such as 1,4 butindiol, o-benzoic acid sulfimide (saccharine), paratoluolsulfonamide, and mixtures of these substances. The bath with such brighteners and an electrolyte prevailingly containing cobalt should be operated at an electrolyte temperature of 50 to 70° C. and a current density of 6–15 A/dm$^2$. The pH value of the electrolyte bath should preferably be set to 4.0.

The following text indicates, as examples, five different steel compositions suitable, according to the present invention, for the base material of a thickness of 0.1 to 1 mm:

1. Unalloyed, Carbon-Lean Steel
Carbon 0.010–0.100%
Manganese 0.140–0.345%
Silicon max. 0.06%
Phosphorus max. 0.025%
Sulfur max. 0.030%
Aluminum 0.02–0.08%
Nitrogen max. 0.0080%
Copper max. 0.10%
Chromium max. 0.10%
Nickel max. 0.10%
Boron max. 0.006%
Titanium max. 0.015%
Rest: Iron 2. Decarbonized Steel (Interstitial-Free Steel)
Carbon max. 0.010%
Manganese 0.10–0.25%
Silicon max. 0.15%
Phosphorus max. 0.020%
Sulfur max. 0.020%
Aluminum 0.015–0.060%
Nitrogen max. 0.004%
Copper max. 0.08%
Chromium max. 0.06%
Nickel max. 0.10%
Titanium 0.02–0.10%
Niobium max. 0.10%
Rest: Iron 3. Low-Carbon Steel
Carbon 0.010–0.020%
Manganese 0.50–0.70%
Silicon max. 0.06%
Phosphorus max. 0.025%
Sulfur max. 0.020%
Aluminum 0.02–0.08%
Nitrogen max. 0.009%
Copper max. 0.12%
Chromium max. 0.06%
Nickel max. 0.10%
Rest: Iron 4. Micro-Alloyed Steel
Carbon max 0.10%
Manganese max. 1.65%
Silicon max. 0.50%
Phosphorus max. 0.12%
Sulfur max. 0.030%
Aluminum at least 0.015%
Niobium max. 0.09%
Titanium max. 0.22%
Vanadium max. 0.25%
Rest: Iron 5. Super High-Strength, Micro-Alloyed Steel
Carbon max 0.25%
Manganese max. 1.65%
Silicon max. 0.60%
Aluminum min. 0.02%
Phosphorus max. 0.025%
Sulfur max. 0.035%
Vanadium min. 0.03%
Niobium min. 0.03%
Molybdenum min. 0.20%
Rest: Iron (The percentage value designate weight percent).

What is claimed is:

1. A method for producing improved cold band suitable for drawing or ironing process, with a carbon content of less than 0.5 weight percent, said cold band having two surfaces, the method comprising the steps of:

rolling the cold band under a cold-rolling ratio of at least 30% and less than 95%;

annealing the cold band by a thermal treatment in an annealing furnace; and coating the cold band on at least one of the surfaces, wherein the annealing step occurs in the form of annealing of the band in a continual annealing furnace and wherein the annealing step occurs at a temperature of more than 911° C. and, therefore, at any rate above the limit temperature of the two-phase range ferrite/austenite ($\alpha/\gamma$ range in the iron-carbon system) to austenite range ($\gamma$ range in the iron-carbon system) wherein a first coating step occurs before the annealing step, and after the annealing step, a second coating is deposited on the band.

2. The method of claim 1, wherein, after the annealing, an additional coating of the band occurs using organic ingredients to enhance the brittleness of the coating.

3. The method of claim 2, wherein the organic ingredients are brighteners.

4. The method of claim 2, wherein the organic ingredients introduced into the coating are the decomposition products of organic substances in an electrolyte bath.

5. The method of claim 2, wherein the organic ingredients introduced into the coating are the reaction products of organic substances in an electrolyte bath.

6. The method of claim 1, wherein conductive particles are embedded into the coating.

7. The method of claim 6, wherein the conductive particles comprise carbon.

8. The method of claim 6, wherein the conductive particles comprise carbon black.

9. The method of claim 6, wherein the conductive particles comprise graphite.

10. The method of claim 6, wherein the conductive particles comprise $TaS_2$.

11. The method of claim 6, wherein the conductive particles comprise $TiS_2$.

12. The method of claim 6, wherein the conductive particles comprise $MoSi_2$.

13. The method of claim 1, wherein the coating is covered with a dispersion-hardened coating containing conductive particles.

14. The method of claim 13, wherein the conductive particles comprise carbon.

15. The method of claim 13, wherein the conductive particles comprise carbon black.

16. The method of claim 13, wherein the conductive particles comprise graphite.

17. The method of claim 13, wherein the conductive particles comprise $TaS_2$.

18. The method of claim 13, wherein the conductive particles comprise $TiS_2$.

19. The method of claim 13, wherein the conductive particles comprise $MoSi_2$.

20. The method of claim 1, wherein the coating step is a galvanic process.

21. The method of claim 20, wherein the coating contains nickel.

22. The method of claim 20 wherein the coating contains cobalt.

23. The method of claim 20 wherein the coating contains iron.

24. The method of claim 20 wherein the coating contains bismuth.

25. The method of claim 20 wherein the coating contains indium.

26. The method of claim 20 wherein the coating contains palladium.

27. The method of claim 20 wherein the coating contains gold.

28. The method of claim 20 wherein the coating contains at least two elements selected from the group consisting of: nickel, cobalt, iron, bismuth, indium, palladium, and gold.

29. The method of claim 1, wherein the second coating step is made by electroplating.

30. The method of claim 29, wherein the coating comprises nickel.

31. The method of claim 29 wherein the coating comprises cobalt.

32. The method of claim 29 wherein the coating comprises iron.

33. The method of claim 29 wherein the coating comprises bismuth.

34. The method of claim 29 wherein the coating comprises indium.

35. The method of claim 29 wherein the coating comprises palladium.

36. The method of claim 29 wherein the coating comprises gold.

37. The method of claim 29 wherein the coating comprises at least two elements selected from the group consisting of: nickel, cobalt, iron, bismuth, indium, palladium, and gold.

38. The method of claim 24, wherein, after the annealing, an additional coating of the band occurs using organic ingredients to enhance the brittleness of the coating.

39. The method of claim 38, wherein the organic ingredients introduced into the coating are the decomposition products of organic substances in an electrolyte bath.

40. The method of claim 38, wherein the organic ingredients introduced into the coating are the reaction products of organic substances in an electrolyte bath.

41. The method of claim 38, wherein the organic ingredients are brighteners.

42. A method for producing improved cold band suitable for drawing or ironing process, with a carbon content of less than 0.5 weight percent, said cold band having two surfaces, the method comprising the steps of:

rolling the cold band under a cold-rolling ratio of at least 30% and less than 95%;

annealing the cold band by a thermal treatment in an annealing furnace; and coating the cold band on at least one of the surfaces, wherein the annealing step occurs in the form of annealing of the band in a continual annealing furnace before or after the coating and wherein the annealing step occurs at a temperature of more than 911° C. and, therefore, at any rate above the limit temperature of the two-phase range ferrite/austenite ($\alpha/\gamma$ range in the iron-carbon system) to austenite range ($\Delta$range in the iron-carbon system) and wherein conductive particles are embedded into the coating.

43. A method for producing improved cold band suitable for drawing or ironing process, with a carbon content of less than 0.5 weight percent, said cold band having two surfaces, the method comprising the steps of:

rolling the cold band under a cold-rolling ratio of at least 30% and less than 95%;

annealing the cold band by a thermal treatment in an annealing furnace; and coating the cold band on at least one of the surfaces, wherein the annealing step occurs in the form of annealing of the band in a continual annealing furnace before or after the coating and wherein the annealing step occurs at a temperature of more than 911° C. and, therefore, at any rate above the limit temperature of the two-phase range ferrite/austenite ($\alpha/\gamma$ range in the iron-carbon system) to austenite range ($\gamma$ range in the iron-carbon system) and wherein the coating is covered with a dispersion layer containing conductive particles.

* * * * *